US005969639A

United States Patent [19]

Lauf et al.

[11] Patent Number: 5,969,639

[45] Date of Patent: Oct. 19, 1999

[54] TEMPERATURE MEASURING DEVICE

[75] Inventors: Robert J. Lauf, Oak Ridge; Don W. Bible, Clinton; Carl W. Sohns, Oak Ridge, all of Tenn.

[73] Assignee: Lockheed Martin Energy Research Corporation, Oak Ridge, Tenn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/901,708

[22] Filed: Jul. 28, 1997

[51] Int. Cl.[6] ..... H01Q 3/26

[52] U.S. Cl. ..... 340/870.17; 342/368

[58] Field of Search ..... 340/870.17, 870.16, 340/870; 374/120, 121, 163; 342/368

[56] References Cited

U.S. PATENT DOCUMENTS

Re. 32,369 3/1987 Stockton ..... 342/368

5,262,944 11/1993 Weisner ..... 600/300

*Primary Examiner*—Michael Horabik

*Assistant Examiner*—Albert K. Wong

[57] ABSTRACT

Systems and methods are described for a wireless instrumented silicon wafer that can measure temperatures at various points and transmit those temperature readings to an external receiver. The device has particular utility in the processing of semiconductor wafers, where it can be used to map thermal uniformity on hot plates, cold plates, spin bowl chucks, etc. without the inconvenience of wires or the inevitable thermal perturbations attendant with them.

32 Claims, 5 Drawing Sheets

TEMPERATURE MEASURING DEVICE

STATEMENT AS TO RIGHTS TO INVENTIONS MADE UNDER FEDERALLY-SPONSORED RESEARCH AND DEVELOPMENT

This invention was made with United States government support awarded by the United States Department of Energy under contract to Lockheed Martin Energy Research Corporation. The United States has certain rights in this invention.

BACKGROUND OF THE INVENTION

1. Field of the Invention

The present invention relates generally to the field of integrated circuit fabrication. More particularly, the present invention relates to temperature measurement of a wafer in a simulated wafer processing environment, such as, for example, on a heating plate in a vacuum chamber. Specifically, a preferred implementation of the present invention relates to a temperature measurement device wherein a plurality of temperature sensors and an associated signal transmitter are attached to a face of the wafer in the form of a set of integrated circuits.

2. Discussion of the Related Art

In the semiconductor industry, many phases of wafer processing, particularly operations involving photoresist, require extraordinary levels of temperature control and uniformity. It is often necessary that the temperature distribution across a 6" wafer be known and controlled to within a fraction of a degree Centigrade. Wafers are fitted with temperature measurement equipment and placed in the processing equipment under simulated wafer processing conditions. Commercially available measurement tools, such as those made by Sensarray Corporation, rely on hard-wired thermocouples, thermistors, or resistive thermal detectors. The resulting device, therefore, is a silicon wafer with a large number of wires affixed to its surface. These wires are brought into a common sheathed lead and a multipin connector, which plugs into an interface module. The entire setup is fragile, because the wires are extremely thin. Conversely, making the wires thicker has an adverse effect on the accuracy because each lead wire acts as a miniature "cold finger" and thus perturbs the very thermal environment that one seeks to measure. Furthermore, the wires interfere with the placement of probes that might be used if one were measuring temperatures in a wafer test bench. Lastly, it is obvious that a hard-wired wafer cannot be used to measure temperatures in a rotating environment such as an operating photoresist spin bowl.

For example, FIG. 1 shows a commercially available wafer temperature measurement metrology product made by Sensarray. The product consists of a "standard" silicon wafer 110 with temperature sensors 120 attached to or embedded in it at various places. The sensors 120 are then attached to sensor leads 130 that are routed through a stress relief clamp 140. The sensor leads 130 continue on to form an unsheathed high compliant lead section 145 and then a sheathed lead section 150. The sensor leads 130 terminate at a connector 160. The connector 160 can carry the signals from the sensors 120 to an external measurement system (not shown).

FIG. 2 shows a commercially available construction for low pressure bake. In this design the leads 130 form a high compliance flat cable vacuum feedthrough 210.

FIG. 3 shows a thermocouple junction 310 conventionally bonded to a silicon wafer 320 with ceramic 330. The thermocouple junction 310 is located in a re-entrant cavity 340 and connected to a pair of thermocouple wires 350.

FIG. 4 shows a thermocouple junction 410 conventionally bonded to a silicon wafer 420 with high temperature epoxy 430. The thermocouple junction 410 is located in a spherical cavity 440 and connected to a pair of thermocouple wires 450.

FIG. 5 shows a resistance temperature detector (RTD) 510 conventionally bonded into a cylindrical cavity 520 of a silicon wafer 530 with high temperature epoxy 540. The RTD 510 includes current source leads 550 and measurement leads 560.

FIG. 6 shows a thermistor 610 conventionally bonded to a silicon wafer 620 with high temperature epoxy 630. The thermistor 610 includes platinum thermistor leads 640 and is located in a tapered thermistor cavity 650. A pair of copper lead wires 660 is located in a tapered lead cavity 670.

All of the designs shown in FIGS. 1–6 include a number of lead wires. All of the designs are fragile and none can be used when the wafer is being rotated.

Therefore, what is needed is a wafer temperature measurement system that is robust, does not interfere with the placement of probes and can be used in a rotating environment. Heretofore, the requirements referred to above have not been fully met.

SUMMARY OF THE INVENTION

Therefore, there is a particular need for a remote temperature measurement system that can be mounted on a wafer and transmit data during the processing of the wafer. Thus, it is rendered possible to simultaneously satisfy the above-discussed requirements which, in the case of the prior art, are mutually contradicting and cannot be simultaneously satisfied.

It is an object of this invention to provide a wireless device for measuring temperatures at selected points on a planar surface. It is another object to provide a means of measuring temperatures at selected points on a planar surface while that planar surface is moving or rotating. It is a further object to provide a system for monitoring temperatures in a simulated semiconductor processing environment. It is yet another object to provide a means of temperature measurement that eliminates the perturbations caused by external lead wires.

These, and other, aspects of the present invention will be better appreciated and understood when considered in conjunction with the following description and the accompanying drawings. It should be understood, however, that the following description, while indicating preferred embodiments of the present invention and numerous specific details thereof, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the components and operation of model systems provided with the present invention, will become more readily apparent by referring to the exemplary, and therefore nonlimiting, embodiments illustrated in the drawings accompanying and forming a part of this specification, wherein like reference numerals designate the same elements in the several views. It should be noted that the features illustrated in the drawings are not necessarily drawn to scale.

DESCRIPTION OF PREFERRED EMBODIMENTS

The present invention and the various features and advantageous details thereof are explained more fully with reference to the nonlimiting embodiments that are illustrated in the accompanying drawings and detailed in the following description. Descriptions of well known components and processing techniques are omitted so as not to unnecessarily obscure the present invention in detail.

Figure 1:
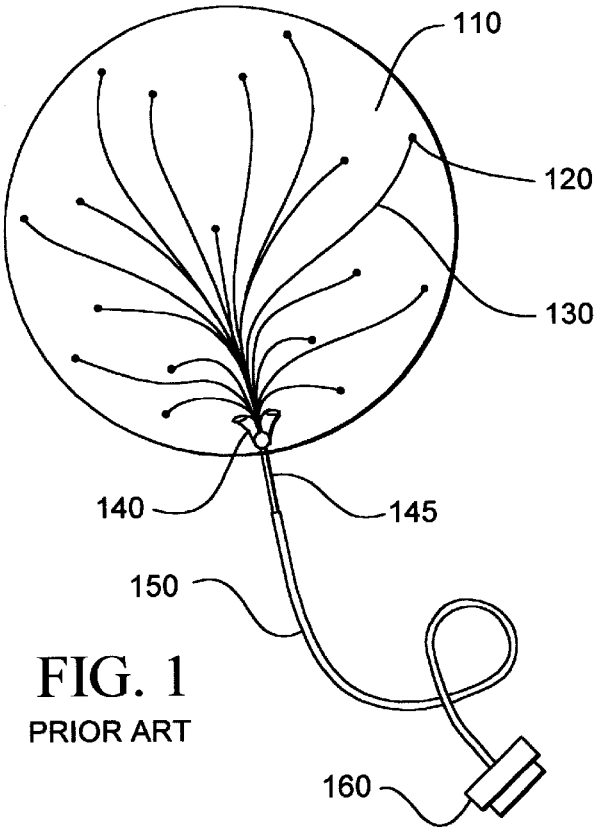
FIG. 1 PRIOR ART
FIG. 1 illustrates a top plan view of a conventional wafer temperature measurement device, appropriately labeled "PRIOR ART"
Figure 2:
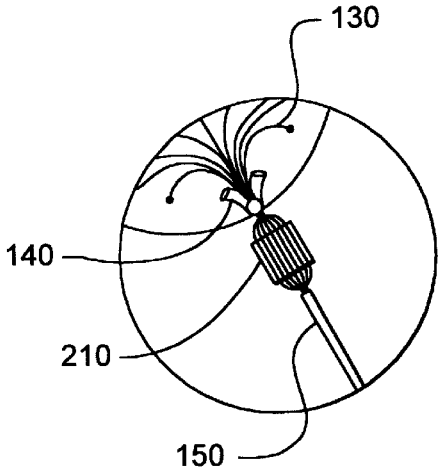
FIG. 2 PRIOR ART
FIG. 2 illustrates a partial top plan view of a conventional wafer temperature measurement device for low pressure bake, appropriately labeled "PRIOR ART"
Figure 3:
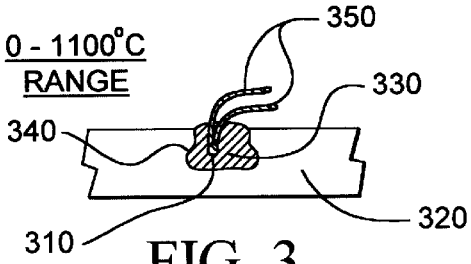
FIG. 3 PRIOR ART
FIG. 3 illustrates a sectional view of a conventional ceramic bonded thermocouple, appropriately labeled "PRIOR ART"
Figure 4:
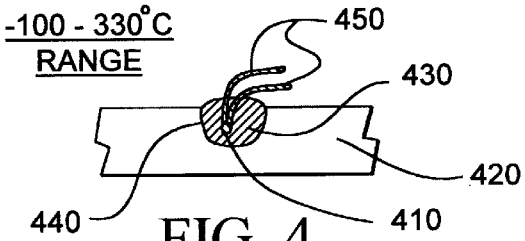
FIG. 4 PRIOR ART
FIG. 4 illustrates a sectional view of a conventional epoxy bonded thermocouple, appropriately labeled "PRIOR ART"
Figure 5:
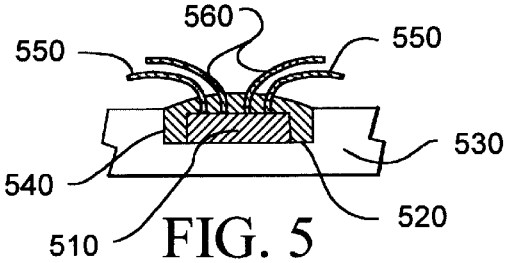
FIG. 5 PRIOR ART
FIG. 5 illustrates a sectional view of a conventional epoxy bonded resistance temperature detector, appropriately labeled "PRIOR ART"
Figure 6:
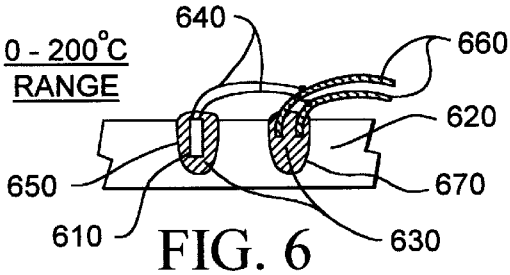
FIG. 6 PRIOR ART
FIG. 6 illustrates a sectional view of a conventional epoxy bonded thermistor, appropriately labeled "PRIOR ART"
Figure 7:
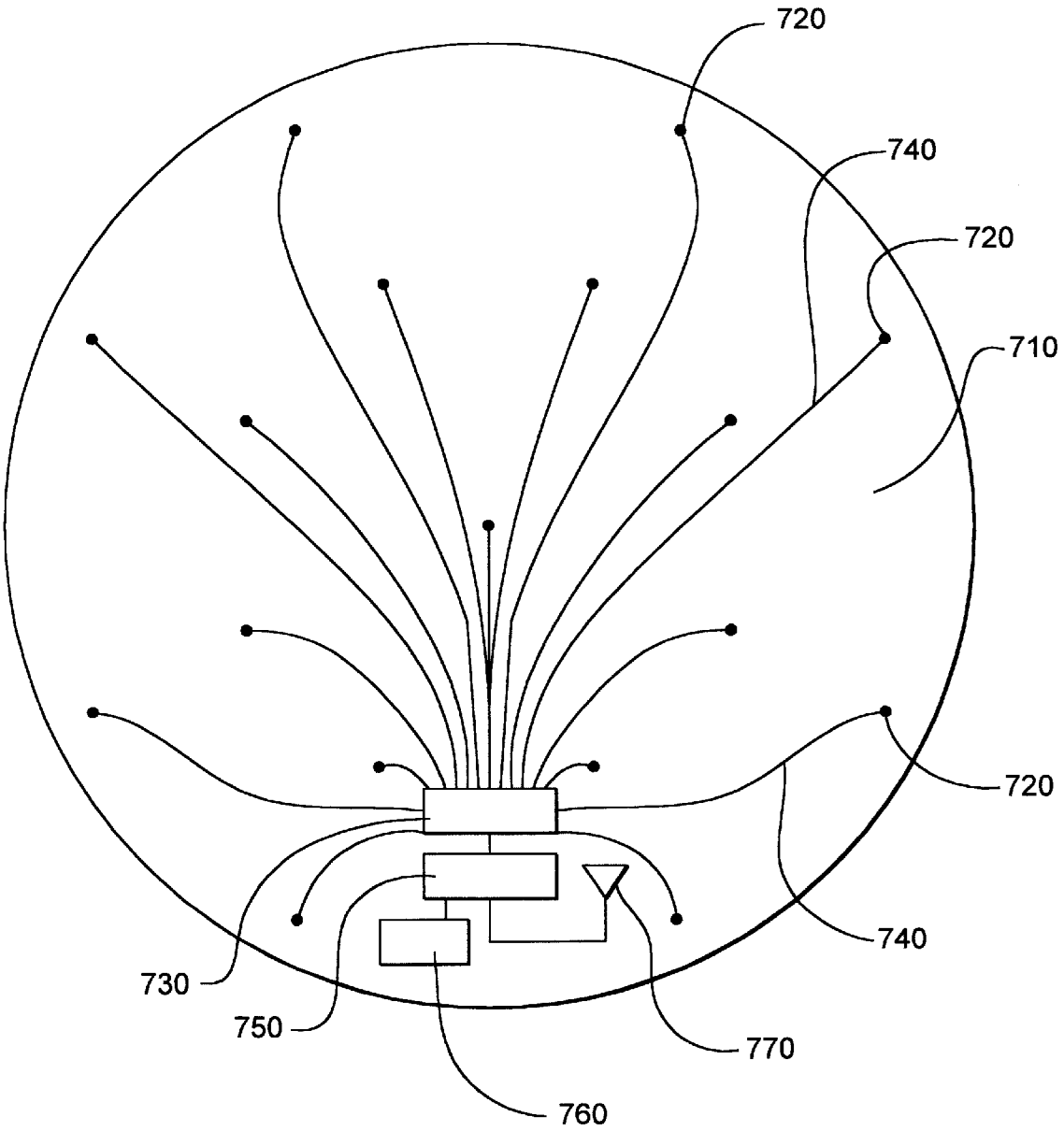
FIG. 7 illustrates a schematic top plan view of a temperature measurement device, representing an embodiment of the present invention.

Referring now to FIG. 7, a general form of the invention is shown where all signal measurement and conditioning circuits are integrated onto an 8" wafer 710. The wafer can be termed a substrate. An array of seventeen sensors 720 is mounted on the wafer 710. Each of the sensors 720 is electrically connected to a signal conditioning circuit 730 with a lead 740. Each of the sensors 720 can be a solid-state temperature sensor. The signal conditioning circuit 730 is electrically connected to a radio frequency (RF) transmitter 750. The transmitter 750 can be termed a signal transmitter. Together, the sensors 720 and the transmitter 750 compose a set of integrated circuits disposed directly upon the substrate 710. The transmitter 750 is electrically connected to a power supply 760 and an antenna 770. The measured temperatures are transmitted to an external receiver (not shown), thereby eliminating any need for lead wires.

The signal conditioning circuit 730 can include a switch for individually activating sensors 720 in a sequential order. In addition, the circuit 730 can includes a clock and a memory whereby temperature data can be captured at selected times and stored for later retrieval. Optionally, the device can also include an RF receiver whereby instructions can be received from an external transmitter and the operations of said device could be controlled thereby.

It can be appreciated that the inventive device requires a large number of innovative features that must be taken together in order for it to work optimally. For example, the device must have its own power supply to drive its circuits and transmitter; this power supply can be a thin-film battery, a capacitor, a photovoltaic device, or an inductive device for receiving transmitted power from an external source. Also, the device must have a means of switching from one sensor to the next, because it is impractical to have all of the sensors transmitting at once to the external receiver. Ideally, the switching configuration will allow all sensors to be operated through one transmitter and antenna, greatly simplifying the overall device. The required circuits represent a tiny fraction of the available area (real estate) on an 8" wafer using conventional IC techniques.

Because one of the advantages of the wireless system is that it now allows one to take measurements while the wafer is rotating (e.g., in air simulating a spin coating process), it follows that novel antenna configurations must be employed in order to transmit the RF signal to the external receiver. In this context, RF must be interpreted broadly to include radio frequencies, microwaves, and optical transmissions. It will also be appreciated that the transmitted signals can be digital or analog and that either amplitude or frequency modulation can be used.

Figure 8:
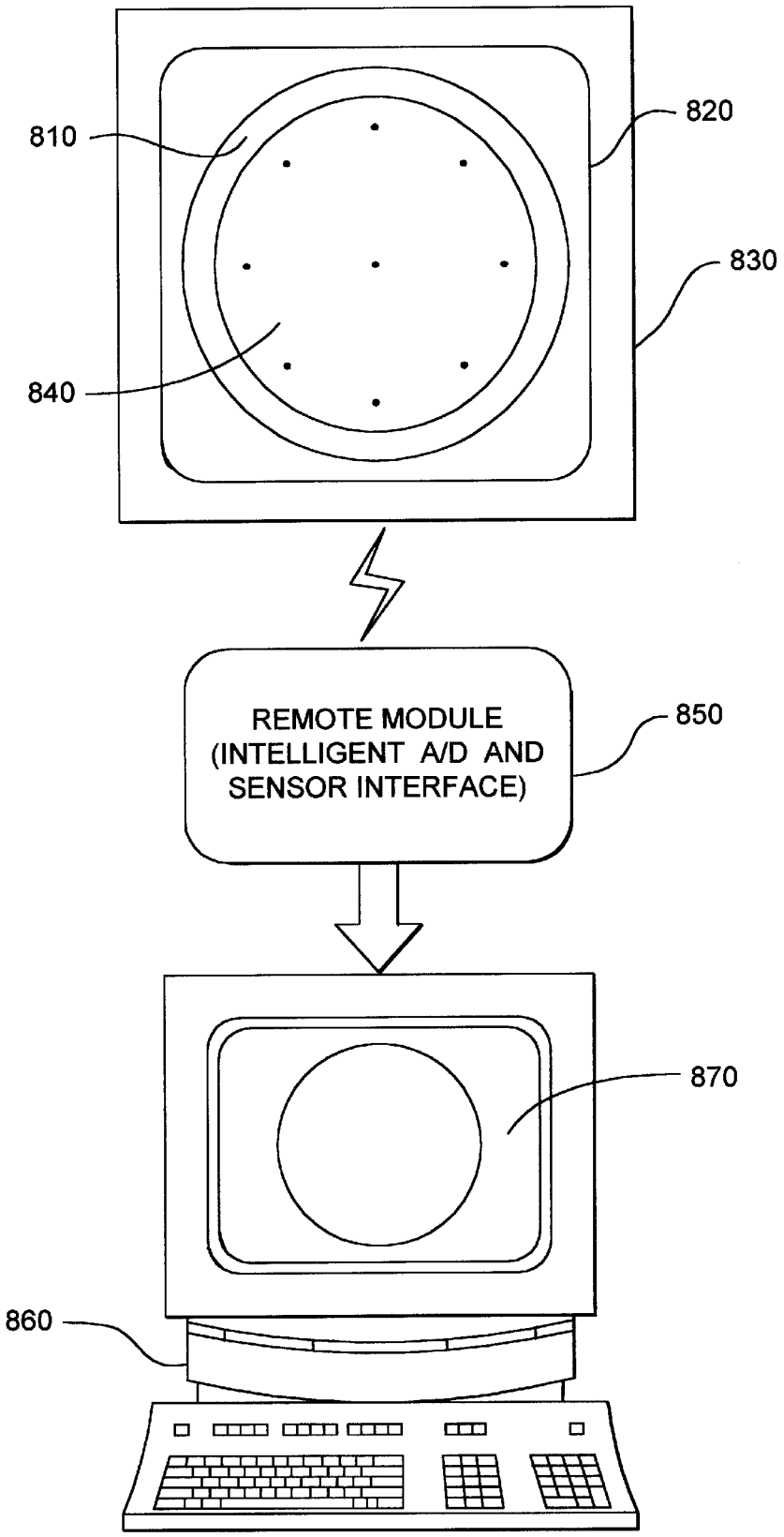
FIG. 8 illustrates a block level schematic view of a portion of a temperature measurement system, representing an embodiment of the present invention.

Referring now to FIG. 8, a complete measurement system using the inventive concepts is shown. A process system hot plate 810 is located in a vacuum chamber 820 that is part of a wafer processing system 830. A wireless RTD instrumented wafer 840 is located on the plate 810. Data from the wafer 840 is transmitted to a remote module 850. The module 850 includes can be termed an external receiver for receiving the output signal from the signal transmitter located on the wafer 810. Module 850 can include an external data processing device for converting the output signal into useful information for a function selected from the group consisting of display, storage, and retrieval. In the depicted embodiment, the received data is then sent to a computer 860 with a high resolution color monitor 870.

EXAMPLES

Specific embodiments of the present invention will now be further described by the following, nonlimiting examples which will serve to illustrate in some detail various features of significance. The examples are intended merely to facilitate an understanding of ways in which the present invention may be practiced and to further enable those of skill in the art to practice the present invention. Accordingly, the examples should not be construed as limiting the scope of the present invention.

Example 1

Figure 9A:
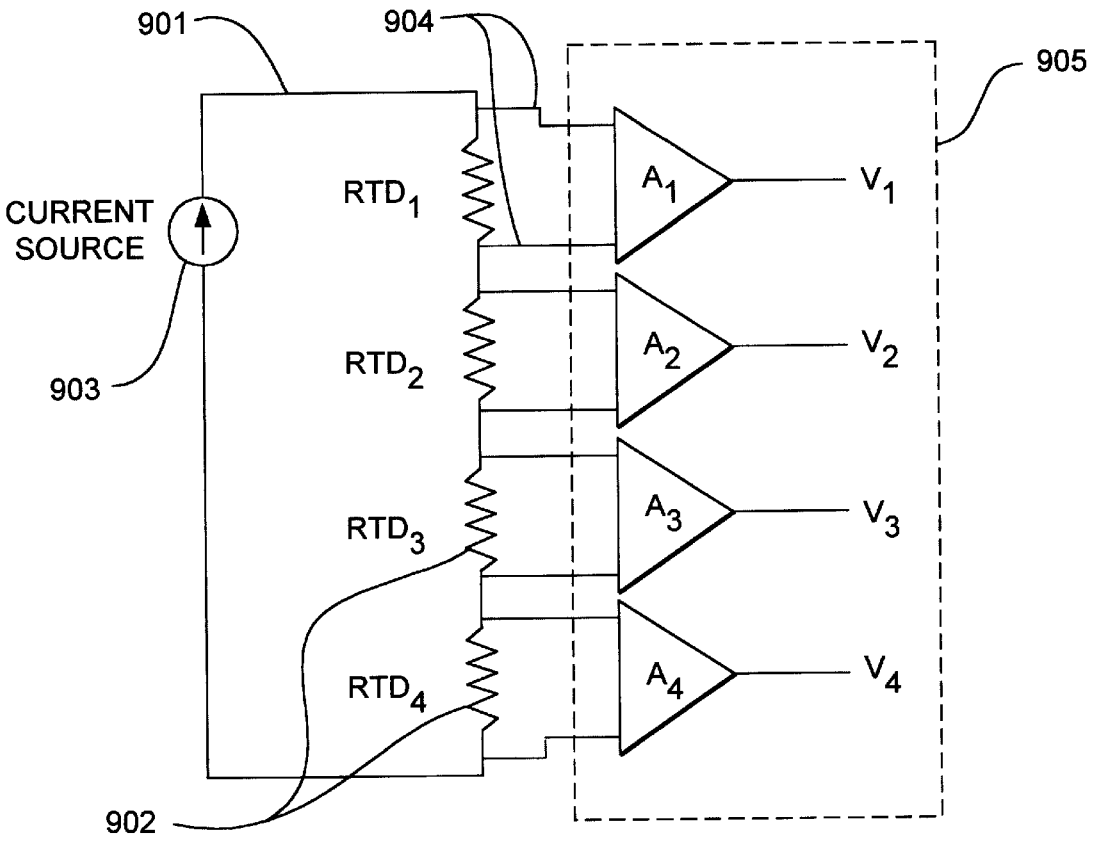
FIG. 9A illustrates a high-level block schematic view of a temperature measurement device, representing an embodiment of the present invention.
Figure 9B:
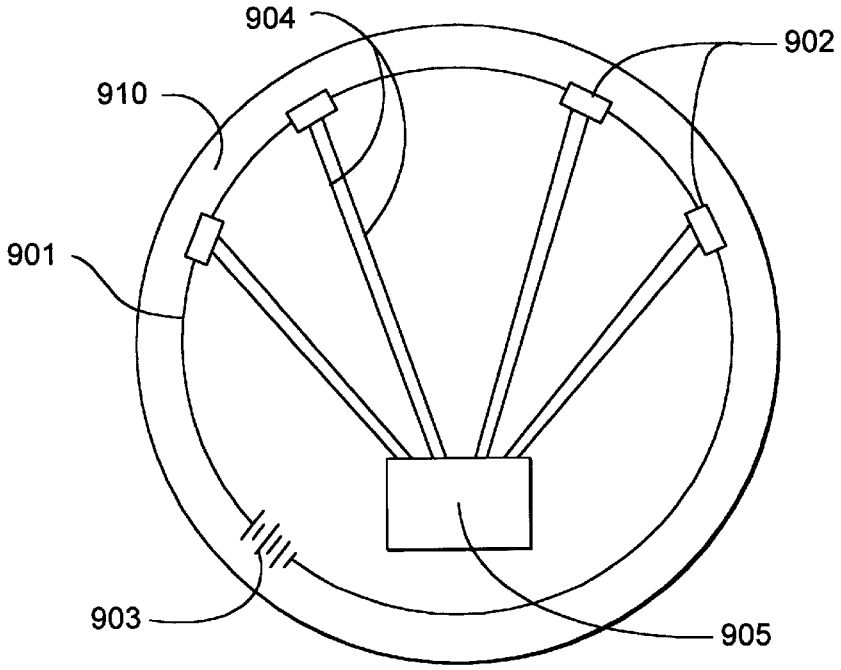
FIG. 9B illustrates a schematic top plan view of the temperature measurement device illustrated in FIG. 9A.

Referring to FIG. 9B, a plurality of resistance temperature detectors RTD's) 902 can be arranged on a wafer 910 with a common current loop 901. The loop 901 is connected to a current source 903 (e.g., a battery). Each of the RTD's 902 is connected to a measurement circuit 905 with a pair of sense leads 904. The voltage drop across each resistance temperature detector (RTD) indicates the absolute temperature of that RTD, and voltage differences between RTD's indicate differential temperatures. In this way, multiple RTD's can be compared to a single reference RTD on the wafer to determine temperature difference profile of the wafer 910 being tested.

Referring to FIG. 9A, a schematic illustration of the apparatus depicted in FIG. 9B is shown. The measurement circuit 905 includes a plurality of elements $A_1$, $A_2$, $A_3$, and $A_4$, each of which produces a voltage signal $V_1$, $V_2$, $V_3$, and $V_4$, respectively. The circuit 905 can include a small data acquisition chip that interrogates individual RTD's or differential RTD's sequentially. The data is transmitted to an external receiver (not shown) for analysis.

Example 2

Without regard to any particular drawing, a plurality of precision centigrade temperature sensors (e.g. National Semiconductor LM35) could be located on a wafer at points to be measured. Each sensor can be energized by a common voltage source of between 5 and 30 volts so as to provide a precise output voltage depending on the temperature of the sensor. The output voltage of the temperature sensors can be interrogated individually to determine the absolute temperature of multiple points or a differential measurement can be made by comparing the output of two sensors and transmitting the differential signal.

Example 3

Without regard to any particular drawing, signals from either RTD's or precision temperature sensors can be converted to frequencies with voltage controlled oscillators (VCO's). Frequencies can then be transmitted as time domain signals via an infrared structure located on the surface of the wafer without perturbing the temperature of the wafer. For instance, infrared emitting diodes could be located near the site where the temperature is being measured so that an optical system used to read the frequency of the transmission could determine the location of the measurement.

In a spinning application, each infrared emitting diode could be placed a known distance from the center of rotation so that individual channels of data could be spatially traced to a particular temperature sensor. The optical monitoring system could determine the output frequency of a given channel in a single cycle of the VCO so that the moving infrared source would not have to be tracked or synchronized.

Example 4

Without regard to any particular drawing, the infrared emitting diodes on the wafer in Example 3 could be monitored by one movable detector or by multiple fixed detectors. In either case, the IR detector(s) could contain circuitry to reject background IR and only respond to changing IR signals associated with the signal from the infrared emitting diode that is intended to be interrogated. The wavelength of the infrared emitting diodes and detectors would be limited so that undesirable sources of IR would be rejected.

Example 5

Without regard to any particular drawing, the signal transmitted by the infrared emitting diodes could be transmitted in the time domain so that data acquisition is easily accomplished with readily commercially available computer hardware and a stable clock frequency. As each channel of data is monitored, the frequency of the wafer mounted VCO could be determined by counting the number of clock cycles that occur during one period of the transmitted signal. This measured frequency can then be correlated to the temperature of the site in question.

Example 6

Figure 10:
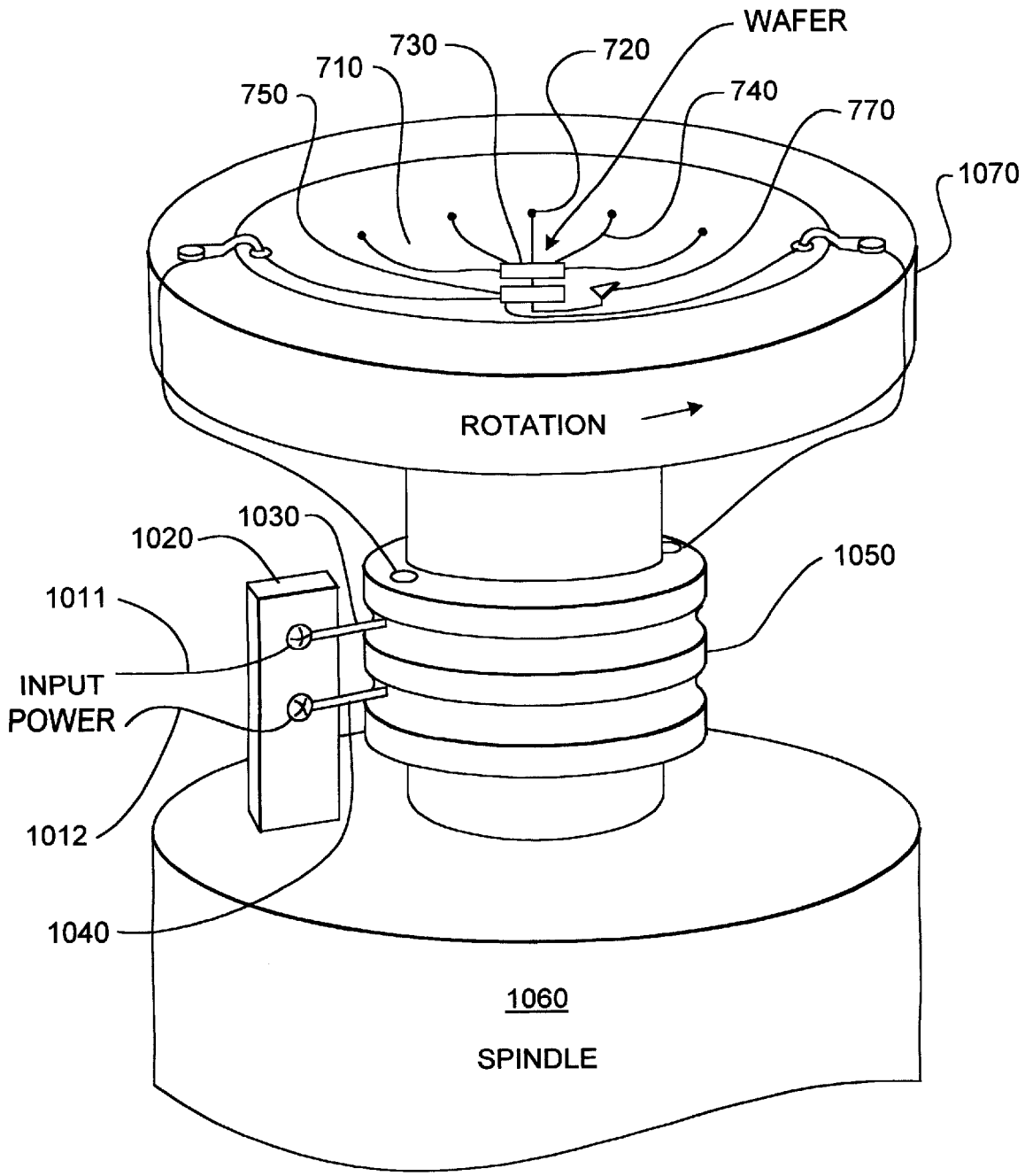
FIG. 10 illustrates a schematic perspective view of a portion of a temperature measurement system, representing an embodiment of the present invention.

Two different basic means, contact and noncontact can supply power to the electronics on the wafer. Referring to FIG. 10, the contact approach involves connecting two input power conductors 1011 and 1012 to the wafer. The conductors 1011 and 1012 are electrically connected to a brush assembly 1020. Brush assembly includes a first brush 1030 and a second brush 1040. The brushes 1030 and 1040 are in contact with a cylindrical bushing 1050 that is mounted on a spindle 1060. A hot plate 1070 is connected to the spindle 1060 and the wafer 710 is mounted on the hot plate with a first clamp 1080 and a second clamp 1090. A first conductor 1085 carries electricity from the first brush 1030 to the first clamp 1080. A second conductor 1095 carries electricity from the second brush 1040 to the second clamp. In this way, uninterrupted power is supplied to the mandrel and the wafer holding mechanism. In an alternative embodiment, the hot plate itself could be one conductor, and the wafer hold-down clamp could be the other conductor. In another alternative embodiment, the hot plate itself could be segmented so that the test wafer could pick up a difference in potential between two segments of the plate and no additional wires would be needed.

Without regard to any particular drawing, noncontact methods include inductive pick-up and photovoltaic methods. The inductive pick-up method would be the more practical of the two to meet the power requirements of the data transmitting devices. This would be implemented by forming a conductive loop on the wafer and applying an alternating magnetic flux to the loop, thereby inducing a voltage in the wafer mounted loop. Care must be taken when using this approach so that alternating magnetic fields do not induce currents in the wafer that produce self heating.

Practical Applications of the Invention

A practical application of the present invention that has value within the technological arts is characterization of wafer temperature profiles while the wafer is undergoing simulated processing. For example, the temperatures at a plurality of locations on a wafer can be measured while the wafer is located on a hot plate so as to characterize the uniformity of wafer temperature. There are virtually innumerable uses for the present invention, all of which need not be detailed here.

Advantages of the Invention

A temperature measurement system, representing an embodiment of the invention is cost effective and advantageous for at least the following reasons. First, the invention has no wires to perturb the thermal measurements, so the device is an inherently more accurate representation of the actual thermal behavior of the wafer being processed. Second, the invention is inherently robust because fragile connecting wires are eliminated. Third, the entire device can be made as a monolithic integrated circuit. Fourth, the invention represents a unique integration of sensor, signal conditioner, power supply, transmitter, and antenna. Fifth, the inventive device can be used while rotating (hard-wired devices obviously cannot). Sixth, the integrated wafer is inherently more amenable to mass production than is the prior art. The prior art requires a great deal of hand work to place the lead wires and temperature sensors.

All the disclosed embodiments of the invention described herein can be realized and practiced without undue experimentation. Although the best mode of carrying out the invention contemplated by the inventors is disclosed above, practice of the present invention is not limited thereto. It will be manifest that various additions, modifications and rearrangements of the features of the present invention may be made without deviating from the spirit and scope of the underlying inventive concept. Accordingly, it will be appreciated by those skilled in the art that the invention may be practiced otherwise than as specifically described herein.

For example, the individual components need not be formed in the disclosed shapes, or assembled in the disclosed configuration, but could be provided in virtually any shape, and assembled in virtually any configuration. Further, the individual components need not be fabricated from the disclosed materials, but could be fabricated from virtually any suitable materials. Further, although the temperature measurement device described herein is a physically separate module, it will be manifest that the temperature measurement device may be integrated into the apparatus with which it is associated. Furthermore, all the disclosed elements and features of each disclosed embodiment can be combined with, or substituted for, the disclosed elements and features of every other disclosed embodiment except where such elements or features are mutually exclusive.

It is intended that the appended claims cover all such additions, modifications and rearrangements. Expedient embodiments of the present invention are differentiated by the appended subclaims.

REFERENCES

1. Eugene A. Avallone et al. eds., *Marks Mechanical Engineering Handbook,* 10*th ed.*, McGraw Hill (1996).
2. Richard C. Dorf et al. eds., *The Electrical Engineering Handbook*, CRC Press, (1993).

What is claimed:

1. A temperature measurement device, comprising:

a silicon semiconductor wafer;

a solid-state temperature sensor mounted on said silicon semiconductor wafer; and a signal transmitter adapted to transmit an output signal of said solid-state temperature sensor to an external receiver from approximately −65° C., to approximately 200° C., said signal transmitter and said solid-state temperature sensor composing a set of integrated circuits disposed directly upon said silicon semiconductor wafer.

2. The device of claim 1, further comprising a plurality of temperature sensors disposed at a plurality of selected locations on said silicon semiconductor wafer such that temperatures at said plurality of selected locations on said silicon semiconductor wafer can be measured.

3. The device of claim 1, further comprising a power source located on said silicon semiconductor wafer.

4. The device of claime 3, wherein said power source includes a thin film device selected from the group consisting of a battery, a capacitor, an inductive pick-up, and a photovoltaic device.

5. The device of claim 4, wherein said power source is fabricated directly upon said silicon semiconductor wafer as part of said set of integrated circuits.

6. The device of claim 1, wherein said temperature sensor includes a temperature detecting element and a signal conditioning circuit.

7. The device of claim 6, wherein said temperature detecting element includes a device selected from the group consisting of a thermocouple, a resistive temperature detector, a thermistor, and a diode.

8. The device of claim 1, wherein said signal transmitter includes an RF transmitter and an antenna, said RF transmitter and said antenna being colocated upon said silicon semiconductor wafer.

9. The device of claim 2, further comprising a switch for individually activating said plurality of temperature sensors in a sequential order.

10. The device of claim 1, further comprising a clock and a memory whereby temperature data can be captured at selected times and stored for later retrieval.

11. The device of claim 1, further comprising an RF receiver whereby instructions can be received from an external transmitter and the operations of said device can be controlled thereby.

12. A system for measuring temperatures at various locations and times in a silicon semiconductor wafer processing environment, comprising:

a temperature measuring device comprising:

a silicon semiconductor wafer;

a solid-state temperature sensor mounted on said silicon semiconductor wafer;

a signal transmitter adapted to transmit an output signal of said temperature sensor to an external receiver from approximately −65° C. to approximately 200° C., said signal transmitter and said temperature sensor composing a set of integrated circuits disposed directly upon said silicon semiconductor wafer;

an external receiver located outside said silicon semiconductor wafer processing environment, said external receiver adapted to receive said output signal from said signal transmitter; and an external data processing device coupled to said external receiver, said external data processing device adapted to convert said output signal into useful information for a function selected from the group consisting of display, storage, and retrieval.

13. The system of claim 12, wherein said temperature measuring device further includes a plurality of temperature sensors disposed at a plurality of locations about said silicon semiconductor wafer such that temperatures at said plurality of locations can be measured thereby.

14. The system of claim 12, wherein said temperature measuring device includes a power source, said power source being located upon said silicon semiconductor wafer.

15. The system of claim 14, wherein said power source includes a thin film device selected from the group consisting of a battery, a capacitor, an inductive pick-up and a photovoltaic device.

16. The system of claim 14, wherein said power source is fabricated directly upon said silicon semiconductor wafer as a part of said set of integrated circuits.

17. The system of claim 12, wherein said temperature sensor includes a temperature detecting element and a signal conditioning circuit.

18. The system of claim 17, wherein said temperature detecting element is a device selected from the group consisting of a thermocouple, a resistive temperature detector, a thermistor, and a diode.

19. The system of claim 12, wherein said signal transmitter includes an RF transmitter and an antenna, said transmitter and said antenna being colocated upon said silicon semiconductor wafer.

20. The system of claim 13, further comprising a switch for individually activating said plurality of temperature sensors in a desired sequential order.

21. The system of claim 12, further comprising a signal conditioning circuit electrically connected to said solid-state temperature sensor and said signal transmitter, said signal conditioning circuit including a clock and a memory whereby temperature data can be captured at selected times and stored for later retrieval.

22. The system of claim 12, further comprising an RF receiver located on said silicon semiconductor wafer whereby instructions can be received from an external transmitter and the operations of said temperature measuring device can be controlled thereby.

23. The system of claim 12, wherein said temperature measuring device includes at least two temperature sensing devices, a signal conditioner circuit, a power supply, an RF transmitter, and an antenna, all of which are fabricated as a monolithic integrated circuit upon said silicon semiconductor wafer.

24. The device of claim 2, wherein said plurality of temperature sensors are a plurality of resistance temperature detectors, and, further comprising a common current loop electrically connected to said plurality of resistance temperature detectors.

25. The device of claim 2, wherein said plurality of temperature sensors are energized by a common voltage source.

26. The device of claim 1, wherein said signal transmitter includes an infrared emitting diode, and, further comprising a voltage controlled oscillator electrically connected between said temperature sensor and said infrared emitting diode.

27. The system of claim 13, wherein said signal transmitter includes a plurality of infrared emitting diodes and said external receiver includes a movable infrared sensor.

28. The device of claim 2, wherein said signal transmitter includes an infrared emitting diode and said output signal includes a time domain signal.

29. A method, comprising:

sensing a temperature on a silicon semiconductor wafer with a solid-state temperature sensor that is mounted on said silicon semiconductor wafer; and transmitting an output signal of said solid-state temperature sensor from approximately −65° C. to approximately 200° C., to an external receiver from a signal transmitter, said signal transmitter and said solid-state temperature sensor composing a set of integrated circuits disposed directly upon said silicon semiconductor wafer.

30. The method of claim 29, further comprising sensing a plurality of temperatures with a plurality of temperature sensors that are energized by a common voltage source and performing a differential measurement by comparing the output of two of the plurality of temperature sensors and transmitting a differential signal.

31. The device of claim 1, further comprising a mandrel, said silicon semiconductor wafer being mounted on said mandrel;

a bushing connected to said mandrel; and a set of brushes in contact with said bushing.

32. The system of claim 12, further comprising a mandrel, said silicon semiconductor wafer being mounted on said mandrel;

a bushing connected to said mandrel; and a set of brushes in contact with said bushing.

* * * * *